United States Patent [19]

Canfield

[11] 4,270,689

[45] Jun. 2, 1981

[54] METHOD OF FORMING A TUBE STRUCTURE FOR USE IN A LAP JOINT

[75] Inventor: Ray E. Canfield, Grinnell, Iowa

[73] Assignee: Donaldson Company, Inc., Minneapolis, Minn.

[21] Appl. No.: 75,651

[22] Filed: Sep. 14, 1979

Related U.S. Application Data

[60] Division of Ser. No. 922,689, Jul. 7, 1978, abandoned, which is a continuation of Ser. No. 773,848, Mar. 3, 1977, abandoned.

[51] Int. Cl.[3] ..... B23K 31/06

[52] U.S. Cl. ..... 228/152

[58] Field of Search ..... 228/146, 147, 152

[56] References Cited

U.S. PATENT DOCUMENTS

| | | | |
|---|---|---|---|
| 382,468 | 5/1888 | Haley | 285/403 |
| 1,053,614 | 2/1913 | Layne | 228/147 X |
| 2,202,909 | 6/1940 | Hufferd et al. | 228/152 X |
| 3,336,056 | 8/1967 | Cassel et al. | 285/137 |
| 3,918,626 | 11/1975 | McLain | 228/152 X |

OTHER PUBLICATIONS

Martin German Printed Application (Offenlegungsschrift), No. 2448160, (9-10-75), Published 7-5-75, Dwgs. & pp. 13-27.

*Primary Examiner*—Gil Weidenfeld
*Assistant Examiner*—K. J. Ramsey
*Attorney, Agent, or Firm*—Merchant, Gould, Smith, Edell, Welter & Schmidt

[57] ABSTRACT

A method of forming an exhaust gas conduit tube wherein a plurality of captured take-up slots in the tubular wall define a deformable region near a free end of the tube, which region will cooperate with clamping means encircling the region to clamp the tube to a second tube inserted telescopically therein. The captured nature of the slots enhances the structural integrity of the tube end. The method includes forming the apertures along an edge of flat steel stock, rolling the steel stock into a tube wherein the apertures are adjacent a free end and welding the longitudinal seam. The free end portion is further flared for strength and to facilitate entry of a second tube.

6 Claims, 6 Drawing Figures

METHOD OF FORMING A TUBE STRUCTURE FOR USE IN A LAP JOINT

This is a division of pending prior application Ser. No. 922,689, filed July 7, 1978 and entitled "Exhaust Tube End For Lap Joint", which was a continuation of prior application Ser. No. 773,848, filed on Mar. 3, 1977 under the same title, both now abandoned.

BACKGROUND OF THE INVENTION

1. Field of the Invention

This invention relates generally to the field of gas conduit tubes, and more particularly concerns the structure of the end portion of gas conduit tubes, which structure facilitates the connection of telescopically communicating exhaust pipes.

2. Description of the Prior Art

It is an object of most automotive exhaust systems to provide a conduit for directing exhaust gas from the engine to a remote exhaust port. It is common in such exhaust systems that the exhaust gas conduit may link several devices for treating the exhaust gas before passing it to the exhaust port. For example, a typical exhaust system may include a muffler, a resonator, an air cleaner aspirator, a catalytic converter, or any combination of these. It is also common that such exhaust systems must be designed to be compatible with various drive trains, chassis sizes, body styles, and the like. For these reasons, the exhaust gas conduit is generally made up of several exhaust tubes or pipes of various shapes and lengths, which are linked together to form a continuous enclosed path for the exhaust gas to follow.

The most common way of joining pipes to construct an exhaust conduit is to utilize a lap joint, wherein succeeding tubes of smaller end diameter are fitted telescopically into preceding tubes of larger end diameter, and clamped in the region where the tubes overlap. Clamping means which encircle the outer tube are tightened down so as to crimp the outer tube onto the inner tube at the point of overlap.

In order to facilitate the crimping of the outer tube to the inner tube, exhaust tubes generally have one end formed with a plurality of slots running parallel to the longitudinal axis of the tube and extending from the tube end inwardly for a distance of 1½ to 3 inches. A number of these slots are placed around the circumference of the tube at its end. A typical muffler connecting tube is shown in the patent to Bryant, U.S. Pat. No. 2,825,421. A similar slotted tube end construction is shown in a patent to L. H. Billey, U.S. Pat. No. 3,137,553, for an air cleaner aspirator.

The slots in such outer tube configurations allow the outer tube to be deformed, or crimped, inwardly on an inner tube placed telescopically within the outer tube, by the action of a clamp encircling the outer tube in the region of the slots, more easily than if the tubular wall were unbroken in the clamping region.

This is the most common exhaust tube end construction, and there are several problems with it. The primary problem with such a slotting arrangement is that a slotted tube has a discontinuous, broken end. This broken end is very susceptible to deformation during packaging, handling, and shipping of exhaust tubes. Since the lap joint construction requires fairly close tolerances between the inner diameter of the outer tube and the outer diameter of the inner tube, slight deformations, out of roundness, etc., in the outer tube may make it very difficult, if not impossible, to telescopically fit the inner tube therein.

Another problem with the presently known slotted tube end arises during construction of the tubes. Most exhaust tubes are constructed from aluminized steel flat stock, which is first slotted, then rolled into tubular form and welded along the seam. The heat from the welding operation causes contraction and expansion in the portions of the tube between the slots. This warpage also creates out-of-round and tolerance problems in the finished product.

SUMMARY OF THE INVENTION

This invention embodies the idea that by "capturing" the end slots, an exhaust tube with more structural integrity at its end can be created, while still retaining the facility for deformation by an encircling clamp. Captured slots are slots which are adjacent the free end of the exhaust tube, but which do not extend all the way through the free end of the tube. Thus, the portions of the tube between the slots are connected at the free end of the tube by a portion of the tubular wall. This captured slot configuration results in an outer tube structure which is not as susceptible to deformation during handling and shipping, or heat warpage during welding, as the slotted outer tube structure currently used.

In a further refinement in accordance with the present invention, the exhaust tube is flared so that its free end has a greater inside diameter than the inside diameter of the tube in the region of the slots. This flaring results in an even more structurally sound tube end configuration.

In either form, the improved tube end structure of the present invention retains its capacity to be crimped onto an inner tube when used in cooperation with any suitable clamping means, by virtue of the "take-up" ability provided by the slots.

DESCRIPTION OF THE PREFERRED EMBODIMENT

Figure 4:
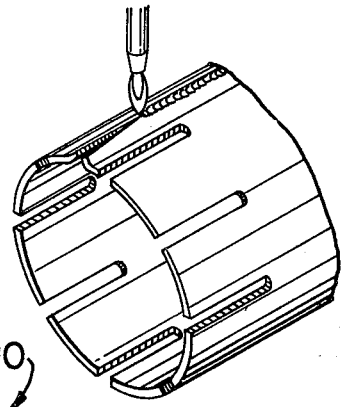
FIG. 4 PRIOR ART
FIG. 4 is a view in perspective of a conventional slotted exhaust tube, showing warpage of the tube end due to heat generated during the tube welding process.
Figure 2:
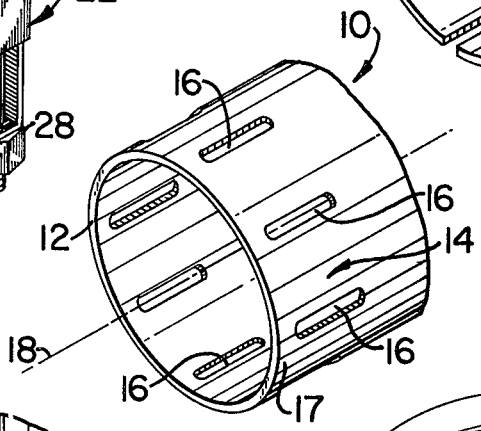
FIG. 2 is a perspective view of the free end and end portion of an outer exhaust tube constructed in accordance with the present invention.

Referring first to FIG. 2, there is shown the end construction of an exhaust tube 10 constructed in accordance with the present invention. Free end 12 of tube 10 is continuous and unbroken. Adjacent free end 12 is an annular end portion 14 comprising the tubular wall of tube 10, and having a plurality of captured slots 16 contained therein. Slots 16 entend parallel to longitudinal axis 18 of tube 10. Furthermore slots 16 are "captured" in that they do not extend through free end 12, as do slots in a conventional exhaust tube end, as shown in FIG. 4.

Although elongated slots which extend parallel to the axis of the tube are shown, other configurations can be used, as well as take-up openings which extend other than parallel to the axis, without departing from my invention.

This configuration defines an unbroken annular ring 17 extending around the tube 10 between free end 12 and slots 16. The presence of unbroken ring 17 provides for structural integrity at free end 12 and end portion 14 of tube 10. In a typical embodiment, tube 10 has an inside diameter of four inches, slots 16 are one inch by 3/16 inch wide, and are eight in number, being spaced equidistantly around end portion 14, at a distance of ¼ inch from free end 12.

Outer tube 10 is constructed of a flat sheet of aluminized steel. Apertures are created by passing the flat sheet of steel through a punch press. The flat sheet, so perforated, is then rolled and butt-welded to create a tube. The welding operation is shown in FIG. 4, wherein is disclosed a conventional, slotted tube end. As is shown in FIG. 4, the heat from the welding operation causes warpage at the tube end of a conventional slotted tube.

Figure 3:
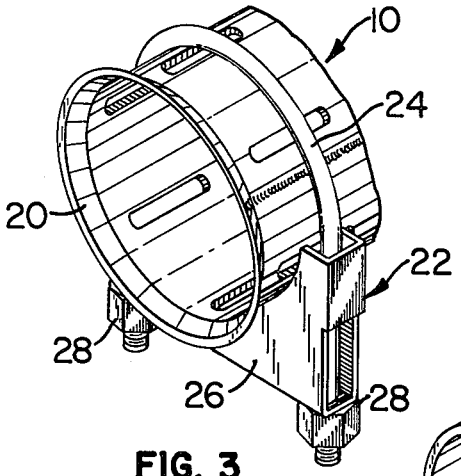
FIG. 3 is a view in perspective showing the flared end embodiment of the present invention in combination with a typical exhaust tube clamp.
Figure 6:
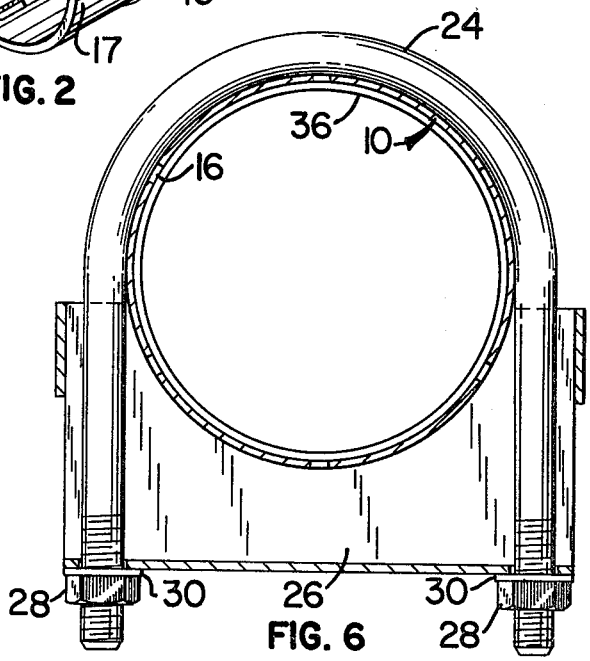
FIG. 6 is an enlarged sectional view taken along line 6—6 of FIG. 1, with portions thereof broken away.

Referring now to FIG. 3, there is shown a further modification of the present invention, wherein outer tube 10 has a flared end portion 20. This continuous, unbroken, flared end portion also results in a very strong end construction which is not susceptible to bumps and dents which would deform the end during shipping. Also shown in FIG. 3 is a typical clamping means 22 encircling tube 10 in the region of slots 16. Clamping means 22 is a selectively adjustable saddle clamp comprising a U-bolt 24, a saddle 26, which slidably engages U-bolt 24, and a pair of threaded nuts 28, threadedly engaging the ends of U-bolt 24. Clamping means 22 is also shown clearly in FIG. 6, wherein it is also shown that a pair of washers 30 are placed between nuts 28 and saddle 26 on the ends of U-bolt 24. It is understood, of course, that the present invention is not limited to the use of a saddle clamp such as is disclosed in FIGS. 3 and 6. In fact, any suitable clamping means known in the industry may be used in combination with an outer tube 10 having captured slots 16, in accordance with the present invention.

Figure 1:
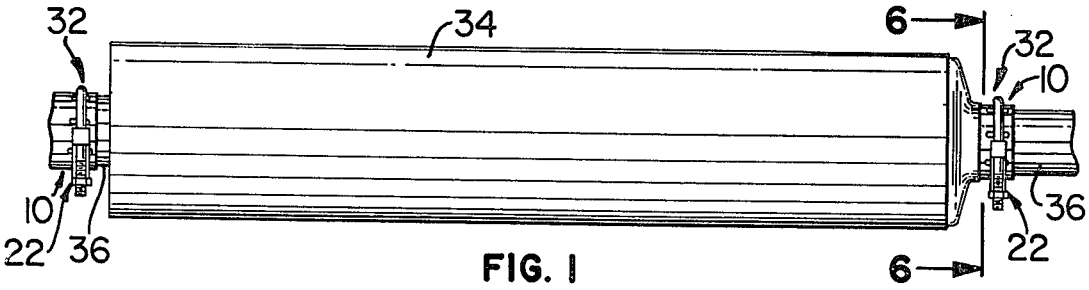
FIG. 1 is a side elevation of a typical exhaust muffler, showing how the lap joint of the present invention may be utilized in combination therewith.
Figure 5:
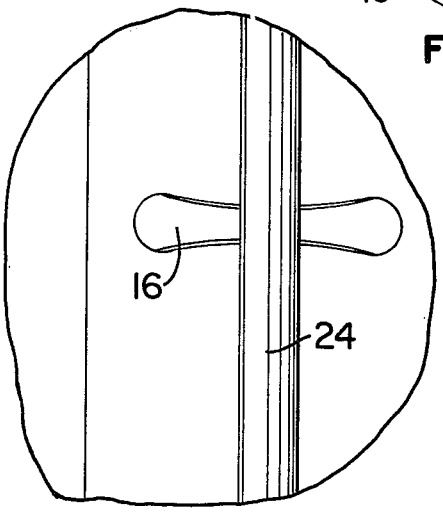
FIG. 5 is an enlarged top plan view of a portion of FIG. 1, showing how a captured take-up slot deforms in response to clamping.

Referring now to FIG. 1, there is disclosed a pair of lap joints 32 constructed in accordance with the present invention. In the case shown, the lap joints 32 are used to install a muffler 34 in an exhaust system. As is shown, a lap joint 32 comprises outer tube 10, which fits telescopically over the free end portion of an inner tube 36. Inner tube 36 has an outside diameter at its free end which is slightly smaller than the inner diameter of outer tube 10 at free end portion 14. This relationship is clearly shown in FIG. 6. The end of inner tube 36 extends into end portion 14 of outer tube 10 past take-up slots 16. The construction of lap joint 32 is completed by encircling outer tube 10 in the region of slots 16 with clamping means 22. By tightening nuts 28, end portion 14 of outer tube 10 is crimped down on inner tube 36 by the combined action of U-bolt 24 and saddle 26. Captured take-up slots 16 facilitate this crimping action by deforming as is shown in FIG. 5. The take-up slots 16, which were originally uniform in width along their length, are squeezed so as to become narrower in the region where the tightened clamping means overlies them.

It will be appreciated that a lap joint 32 can be used to plumb mufflers of other exhaust gas treatment devices into the exhaust conduit, as well as used for simply connecting various shapes and lengths of exhaust pipe together to make the entire exhaust conduit compatible with the design of the vehicle in which it is being used.

From the foregoing, it can be seen that an improved lap joint and outer tube end construction have been invented, wherein the outer tube is slotted with captured take-up slots, thereby creating a tube end portion not easily deformed by rough handling of the tubes prior to use.

What is claimed is:

1. A method of forming a tube structure for use in a lap joint for the exhaust system of an internal combustion engine, comprising the steps of:

(a) forming a plurality of apertures in a single row along a straight edge of a predetermined length of substantially flat steel stock, the apertures passing entirely through the steel stock, and the steel stock entirely surrounding each aperture in closed relation;

(b) rolling the length of substantially flat steel stock into a tubular form which defines at least one free end with the closed apertures disposed adjacent the free end, the rolled tube defining a longitudinal seam;

(c) and welding the rolled steel stock along the longitudinal seam to define a closed tube the free end of which is adapted to receive the free end of a smaller tube in overlapping relation and to define a lap joint therewith.

2. The method defined by claim 1, wherein the apertures comprise elongated slots that extend in in parallel relation to the axis of the tube.

3. The method defined by claim 2, wherein the apertures are substantially identical in shape.

4. The method defined by claim 3 wherein the apertures are disposed so as to be equidistantly spaced around the circumference of the formed tube.

5. The method defined by claim 1, wherein the steel stock in rolled tubular form defines an open longitudinal seam, and the welding step comprises butt welding the steel stock to close and seal the open longitudinal seam.

6. The method defined by claim 1, which comprises the further step of forming the free end into a flared configuration to strengthen the free end and facilitate entry of a second tube, closed apertures being disposed adjacent the flared, free end.

* * * * *